US008175283B2

(12) United States Patent
Stoop et al.

(10) Patent No.: US 8,175,283 B2
(45) Date of Patent: May 8, 2012

(54) SOUND ANALYZER BASED ON A BIOMORPHIC DESIGN

(75) Inventors: Ruedi Stoop, Humilkon (CH); Albert Kern, Zürich (CH); Johannes Petrus V. D. Vyver, Bedfordview (ZA)

(73) Assignee: University of Zurich, Zurich (CH)

( * ) Notice: Subject to any disclaimer, the term of this patent is extended or adjusted under 35 U.S.C. 154(b) by 1146 days.

(21) Appl. No.: 11/916,874

(22) PCT Filed: May 29, 2006

(86) PCT No.: PCT/CH2006/000282

§ 371 (c)(1),
(2), (4) Date: Dec. 7, 2007

(87) PCT Pub. No.: WO2006/133580

PCT Pub. Date: Dec. 21, 2006

(65) Prior Publication Data

US 2008/0197833 A1 Aug. 21, 2008

(30) Foreign Application Priority Data

Jun. 16, 2005 (EP) ..... 05405389

(51) Int. Cl.
*H04R 5/00* (2006.01)
*H04R 29/00* (2006.01)

(52) U.S. Cl. ..... 381/56; 381/28; 381/58

(58) Field of Classification Search ..... 381/28, 381/56, 58

See application file for complete search history.

(56) References Cited

U.S. PATENT DOCUMENTS

2002/0057808 A1 5/2002 Goldstein

OTHER PUBLICATIONS

Magnasco M O: "A wave traveling over a Hopf instability shapes the cochlear tuning curve" Physical Review Letters, vol. 90, No. 5, Feb. 7, 2003, pp. 58101/1-58101/4.*

Van Der Vyver et al: "Active component implementation of a biomorphic Hopf Cochlea" in Proceedings of the European Conference on Circuit Theory and Design, vol. 3, 2003, pp. 285-288.

Zwicker E: "A hardware cochlear nonlinear preprocessing model with ative feedback" in Journal of the Acoustical Society of America, AIP / Acoustical Society of America, Melville, NY, US, vol. 80, No. 1, Jul. 1, 1986, pp. 146-153.

Eguiluz et al: "Essential nonlinearities in hearing" in Physical Review Letters, New York, NY, US, vol. 84, No. 22, May 29, 2000, pp. 5232-5235.

Magnasco et al: "A wave traveling over a Hopf instability shapes the colchlear tuning curve" in Physical Review Letters, New York, NY, US, vol. 90, No. 5, Feb. 7, 2003, pp. 58101/1-5810/4.

* cited by examiner

*Primary Examiner* — Victor A Mandala

(74) *Attorney, Agent, or Firm* — Agris & von Natzmer LLP; Joyce von Natzmer

(57) ABSTRACT

A device and a method for analyzing sound based on a biomorphic design are disclosed. The device comprises a plurality of amplification/filtering stages (S1, . . . , Sn) connected in a series configuration. Each amplification/filtering stage comprises at least one nonlinear amplification module (100*a*, . . . , 100*c*), preferably a Hopf amplifier, and at least one filter module (200*a*' . . . , 200*c*; 200*a*', . . . 200*c*') providing high-frequency attenuation.

17 Claims, 11 Drawing Sheets

SOUND ANALYZER BASED ON A BIOMORPHIC DESIGN

This is the U.S. national stage of International application PCT/CH2006/000282, filed May. 29, 2006 designating the United States and which claims the benefit of European application 05.405389.7, filed Jun. 16, 2005.

FIELD OF THE INVENTION

The present invention relates to a device and a method for analyzing an audio signal.

BACKGROUND OF THE INVENTION

The first steps in understanding the cochlea, the mammalian hearing organ, were achieved by H. L. F. Helmholtz, who revealed in 1863 the tonotopic principle, followed by von Békésy's discovery of traveling waves along the basilar membrane (BM), and Gold's conjecture of active amplification in the cochlea (1948) which was evidenced by the discovery of otoacoustic emissions (the production of sounds by the ear itself). Since then, various experiments revealed that the locus of active amplification is in the outer hair cells (OHC), that reside on top of the basilar membrane.

Recently, several authors have suggested that Hopf-type instabilities may be responsible for some of the observed features of the biological cochlea (V. M. Eguiluz et al., Phys. Rev. Lett. 84, 5232 (2000); M. O. Magnasco, Phys. Rev. Lett. 90, 058101 (2003); A. Kern and R. Stoop, Phys. Rev. Lett. 91, 128101 (2003); R. Stoop and A. Kern, Phys. Rev. Lett. 93, 268103 (2004); R. Stoop et al., Physica A 351, 175 (2005)). In these papers, some features of the biological cochlea have been reproduced by solving, for stationary input signals, differential equations which correspond to specific mathematical models of the cochlea.

For transient signals, however, computational effort would be too high in order for the suggested methods to be useful in practical applications. No electronic implementations of a cochlea model have been suggested by these authors.

A realistic electronic model of the cochlea is highly desirable in the development of advanced hearing aids such as cochlear implants and in technologies such as robotics where an analysis of the auditory scene is often required. In the past, several attempts have been made to devise an electronic cochlea mimicking the physiological response characteristics of the biological cochlea, in particular the amplitude or velocity distribution along the basilar membrane. Several models have been proposed which use a bank of band-pass filters, all filters receiving the same input signal and each filter being coupled to an amplifier (filter bank models). An early example is U.S. Pat. No. 4,063,048. Other examples include U.S. Pat. Nos. 5,402,493, 5,848,171, 5,500,902 and 6,868,163. Other models are based on a transmission line design, as proposed, e.g., in U.S. Pat. No. 5,030,198. However, often the responses measured on such implementations significantly differ from physiological measurements. In addition, such implementations tend to be rather complicated.

SUMMARY OF THE INVENTION

It is therefore an object of the present invention to provide a device for analyzing an audio signal whose output reproduces salient features of the biological cochlea. In particular, it is an object of the present invention to provide a device which is an electronic implementation of a biomorphic cochlea model. It is a further object of the present invention to provide a method for analyzing an audio signal which provides a plurality of output signals from an input signal, these output signals reproducing salient features of the biological cochlea.

These objects are achieved by a device with the features laid down in claim 1 and by a method according to claim 12.

Thus, a device for analyzing sound is provided, which comprises a plurality of amplification/filtering stages (at least two, preferably at least five). Each amplification/filtering stage has at least one input terminal and at least one output terminal. The amplification/filtering stages are connected in a series configuration (i.e., in a feedforward or cascading fashion). Each amplification/filtering stage comprises at least one nonlinear amplification module and at least one filter module providing high-frequency attenuation.

In the context of the present invention, a nonlinear amplification module is to be understood as a unit providing an output signal whose amplitude, for a sinusoidal steady-state input of a given frequency within its specified working range, depends in a nonlinear way on the input amplitude and preferably exceeds the input amplitude. Preferably the nonlinear amplification module comprises feedback means between its output terminals and its input terminals which provide nonlinear feedback.

The nonlinear amplification module(s) and the filter module(s) are preferably themselves connected in a series configuration (i.e., in a feedforward fashion) between the input terminal and the output terminal of each amplification/filtering stage. Preferably, amplification occurs before filtering. In other words, within each amplification/filtering stage, preferably the input terminals of the amplification/filtering stage are connected directly or indirectly to the input terminals of the nonlinear amplification module, the output terminals of the nonlinear amplification module are connected to the input terminals of the filter modules, and the output terminals of the filter modules are connected to the output terminals of the amplification/filtering stage.

Each nonlinear amplification module acts as a nonlinear filter, which may be described by a transfer function depending on both the frequency and the amplitude of the input signal. Thus, each nonlinear amplification module has a characteristic frequency defined as the frequency at which the absolute value of the transfer function for small input signals is at its maximum.

Each filter module (which is preferably of the Butterworth type, in particular comprising a 6th-order Butterworth filter) has a high-frequency cutoff frequency which is defined as the frequency at which the absolute value of the transfer function of the filter module has fallen off to −30 dB from its maximum. The high-frequency cutoff frequency of each filter module within each amplification/filtering stage is then preferably chosen lower than the characteristic frequency of the nonlinear amplification/filtering module of that amplification/filtering stage. Especially in this case, it is preferred that amplification occurs before filtering in each amplification/filtering stage.

Preferably each amplification/filtering stage has a first input terminal for a first input signal, a second input terminal for a second input signal, a first output terminal for a first output signal and a second output terminal for a second output signal. Each amplification/filtering stage acts to provide said first and second output signals in a manner such that each of these signals depends on both the first and second input signals. In other words, there is a signal path between the first input terminal and the first output terminal as well as between the first input terminal and the second output terminal. Analogously, there is a signal path between the second input terminal and the second output terminal as well as between the second input terminal and the first output terminal.

In the latter case, preferably two filter modules are employed, one each for each of the two input or output terminals of the amplification/filtering stage. In other words, each amplification/filtering stage then preferably comprises a first filter module and a second filter module, said first filter module being connected directly or indirectly to the first input or (preferably) to the first output of said amplification/filtering stage and said second filter module being connected directly or indirectly to the second input or (preferably) to the second output of said amplification/filtering stage, and wherein said first and second filter modules have essentially identical frequency characteristics.

Preferably, the nonlinear amplification module comprises a Hopf-type amplifier. A Hopf-type amplifier is a device having two input terminals and two output terminals. At the first output terminal, the amplifier provides a first output voltage $v_x$. At the second output terminal, it provides a second output voltage $v_y$. The Hopf amplifier comprises integrator means which integrate an input voltage at each of the input terminals and provide the integral to the respective output terminal. It further comprises feedback means which ensure a feedback between the output terminals and the input terminals which is proportional to the sum of the squares of the two output voltages, multiplied by each output voltage. Mathematically speaking, the amplifier provides feedback between the first out-put terminal and the first input terminal which is proportional to $v_x(v_x^2+v_y^2)$, and feedback between the second output terminal and the second input terminal which is proportional to $v_x(v_x^2+v_y^2)$. It also comprises feedback means which provide a linear feedback (a feedback between the first output terminal and the first input terminal proportional to the first output voltage, and a feedback between the second output terminal and the second input terminal proportional to the second output voltage) and a cross-feedback (feedback between the second output and the first input and vice versa, where each feedback is proportional to the respective output voltage).

While the use of a Hopf amplifier is preferred, other types of nonlinear amplifiers, in particular amplifiers having two input terminals and two output terminals and providing feedback of the form $v_x(v_x^2+v_y^2)^\kappa$ and $v_x(v_x^2+v_y^2)^\kappa$, respectively, from the output terminals to the input terminals, may be envisaged. Here, the exponent (order of nonlinearity) $\kappa$ may take any real value. Advantageously, $\kappa \geqq 1$, preferably $\kappa \geqq 2$. Preferred values are in particular $\kappa=1$, 2 or 4.

In order to provide a suitable input signal to the first stage having two inputs, the device advantageously comprises a Hilbert transformer module having an input terminal for a real input signal and a first and a second output terminal. The Hilbert transformer module acts to transform the real input signal into a complex output signal (the so-called analytic signal), a real component of said complex output signal being fed to said first output terminal and an imaginary component of said complex output signal being fed to said second output terminal. The first and second output terminals of the Hilbert transformer are connected to the first and second input terminals of the first of the amplification/filtering stages.

In the context of the present invention, a Hilbert transformer is to be understood as a device having an input terminal for a real-valued, time-dependent signal and two output terminals. The Hilbert transformer generates a first output signal which, apart from an overall amplitude change and a constant phase shift, essentially corresponds to the real input signal, and a second output signal which essentially corresponds to the first output signal shifted, for each frequency contained in its frequency spectrum, by 90 degrees. The latter signal corresponds to the imaginary part of a complex signal of which the first output signal represents the real part. These signals are provided to the first and second output terminals. In addition, the Hilbert transformer may perform other functions, such as some filtering etc. Hilbert transformers are well known in the art.

The device according to the present invention may be implemented in analog or digital hardware or in software as follows. The nonlinear amplification module preferably comprises a first integrator having an input port connected directly or indirectly to the first input terminal of the amplification module and having an output port connected directly or indirectly to the first output terminal of the amplification module. It further comprises a second integrator having an input port connected directly or indirectly to the second input terminal of the amplification module and having an output port connected directly or indirectly to the second output terminal of the amplification module. A positive feedback connection is provided from the output port of the second integrator to the input port of the first integrator, and a negative feedback connection is provided from the output port of the first integrator to the input port of the second integrator (cross-feedback). In addition, nonlinear feedback means for providing a signal essentially proportional to $(v_x^2+v_y^2)\cdot v_x$ to the input port of the first integrator and for providing a signal essentially proportional to $(v_x^2+v_y^2)\cdot v_y$ to the input port of the second integrator are present, where $v_x$ is a voltage at the output port of the first integrator and $v_y$ is a voltage at the output port of the second integrator.

External control of the properties of the nonlinear amplification module may be achieved if the amplification module further comprises a feedback connection between the output port and the input port of the first integrator, the amount of feedback being controllable by an external control parameter, and a feedback connection between the output port and the input port of the second integrator, the amount of feedback being controllable by the same external control parameter. In this way, in particular the gain and/or the bandwidth of the nonlinear amplification module may be controlled.

The filter module(s) of each amplification/filtering stage preferably comprise a lowpass or bandpass filter, preferably of the Butterworth type, whose high-frequency falloff is of at least sixth order.

The output signals of the device may be monitored and employed to control parameters such as the bandwidth of individual stages. In this case, the device advantageously further comprises a control module having at least one input terminal connected to at least one selected output terminal of at least one selected amplification/filtering stage, and having at least one output terminal connected to a control terminal of at least one selected amplification/filtering stage. The control module is operable to derive at least one control parameter from signals provided to its input terminals and to provide said at least one control parameter to the selected amplification/filtering stages.

The present invention also relates to a method for analyzing an audio signal by modeling a cochlea of a mammal in which a plurality of complex-valued output signals are derived from a real-valued input signal. The method comprises the following steps:

deriving a complex-valued transformed input signal from the real-valued input signal; and subjecting said complex-valued transformed input signal to a sequence of amplification and filtering steps, wherein each amplification and filtering step results in one of said complex-valued output signals, and wherein each said complex-valued output signal serves as an input signal for the subsequent amplification and filtering step;

optionally, subjecting each complex-valued output signal to a post-processing step to obtain a modified output signal;

optionally, deriving a set of control parameters from said plurality of output signals and controlling said amplification and filtering steps by said set of control parameters, wherein each amplification and filtering step comprises a non-linear amplification step, preferably an amplification step exhibiting Hopf-type amplification, and a filtering step with a predetermined high-frequency cutoff.

Here, the term "Hopf-type amplification" is to be understood as amplification with an amplitude and frequency characteristics which essentially corresponds to the amplitude and frequency characteristics of a Hopf-type amplifier, as defined above.

BRIEF DESCRIPTION OF THE DRAWINGS

The invention will be described in more detail in connection with exemplary embodiments illustrated in the drawings, in which.

DETAILED DESCRIPTION OF THE INVENTION

Figure 1:
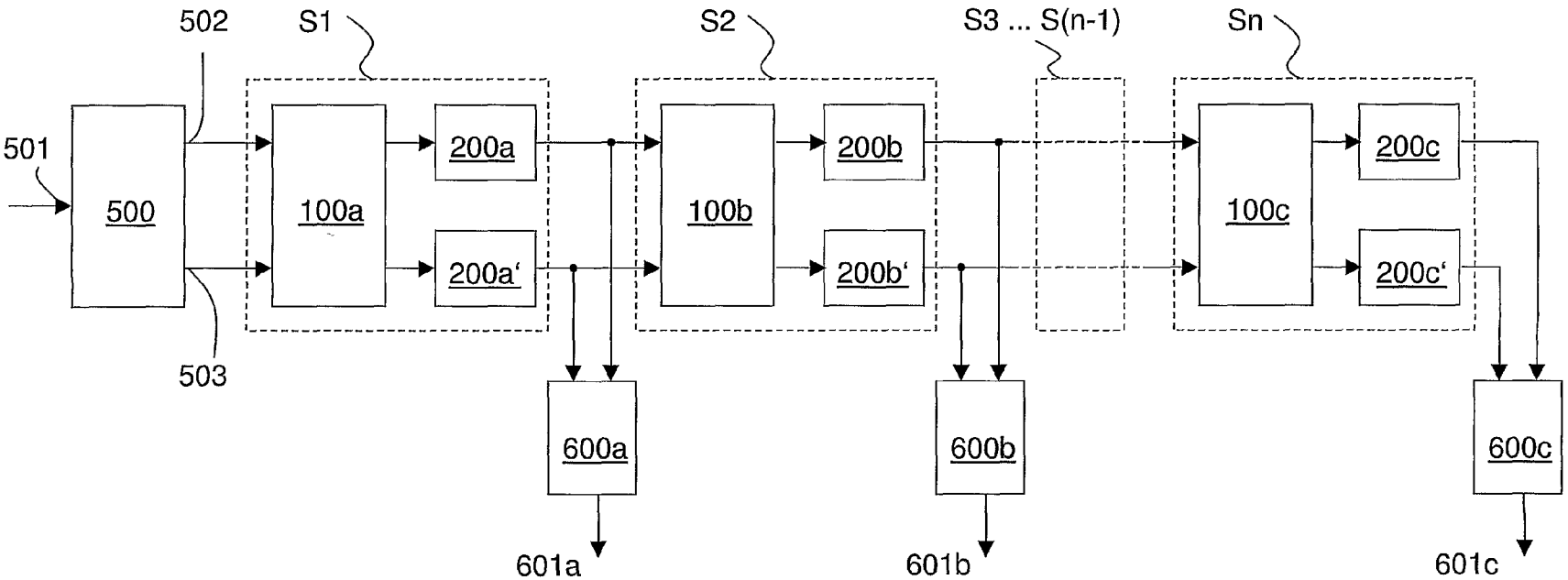
FIG. 1 shows a schematic block diagram of an electronic cochlea according to the present invention.

In the following, some information about the underlying physiological and mathematical models will be given, before a preferred embodiment of the pre-sent invention shall be described in detail.

The basic phenomena of hearing which should be reproduced by a biomorphic cochlea model are: Compression of the dynamic range, sharper tuning for lower intensity sounds, two-tone suppression and the generation of combination tones. In the following, an implementation of a biomorphic electronic cochlea model will be described, which is based on an arrangement of Hopf amplifiers.

The Hopf amplifiers in the cochlea may be considered mechanically connected to the basilar membrane (BM). Mediated by the incompressible and inviscid cochlear fluid, incoming sound pressure variations transform into a hydrodynamic wave along the BM. As the BM displacements are small, the passive membrane-fluid system is described linearly, by a water-surface wave that is endowed with a surface mass density m and exponentially decreasing transversal stiffness $E(x)=E_0 \exp(-\alpha x)$. According to this theory, the wave group velocity $v_G$, the wave vector k, and the stationary energy density distribution $e(x,\omega)$ along the cochlea are related by $$v_G = \frac{\partial \omega}{\partial k} = \frac{E(x)\rho}{2\omega} \frac{kh + \sinh(kh)\cosh(kh)}{(mk\sinh(kh) + \rho\cosh(kh))^2}. \quad \text{(Equation 1)}$$

Between the characteristic frequencies $\omega_c(x)$ and a BM location $x=x_c(\omega)$, the relation $$\omega_c(x)=\sqrt{E(x)/m} \quad \text{(Equation 2)}$$

emerges (the so-called first tonotopic map). It can be shown that $k(x;\omega)$ diverges as $\omega$ approaches the characteristic frequency $\omega_c(x)$ and that, as x approaches the characteristic location $x_c(\omega)$ for fixed $\omega$, the traveling wave stalls ($v_G=0$) at this point of (passive) resonance. Due to dissipative losses, how-ever, the wave amplitude will reach a maximum at $x<x_c(\omega)$, which is consistent with von Békésy's original observations. From the (linear and nonlinear) waves' energy balance equation $$\frac{\partial e}{\partial t} + \frac{\partial}{\partial x}(v_G e) = 0,$$

using the Ansatz $$\frac{\partial e}{\partial t} = :-a + de$$

for the one-dimensional energy density $e(x,\omega)$, the cochlea differential equation $$\frac{\partial e}{\partial x} = \frac{-1}{v_G(x,\omega)}\left[\frac{\partial v_G(x,\omega)}{\partial x} + d(x,\omega)\right]e + \frac{a(x,e,\omega)}{v_G(x,\omega)}, \quad \text{(Equation 3)}$$

is obtained, where the internal viscous losses ($d(x,\omega)=4\nu k(x,\omega)^2$, where $\nu$ is the kinematic viscosity), vs. the local energy supply $a(\cdot)$ by the active Hopf amplification, are the two antagonistic contributions. The active amplification is implemented as an array along the BM, of Hopf-type power sources with varying natural frequencies $\omega_{ch}(x)$. For a given forcing frequency $\omega$, the Hopf amplifiers satisfying $\omega_{ch}(x)\approx\omega$ are maximally excited at locations $x_{ch}(\omega)<x_c(\omega)$, before viscosity leads to a precipitous decay of the wave amplitude.

The active contribution a to the proposed Hopf cochlea is derived from the Hopf differential equation written in A rescaled form (by $\omega_{ch}$) as $$\dot{z}=(\mu+j)\omega_{ch}z-\omega_{ch}|z|^2z-\omega_{ch}F(t), z\in\mathbb{C}, \quad \text{(Equation 4)}$$

where to the external periodic input $F(t)=F\exp(j\omega t)$, $z(t)=R\exp(j(\omega t+\theta))$ may be considered as the amplified signal and a 1:1 locking between signal and system is assumed. The symbol j denotes the imaginary unit $j^2=-1$, $\omega_{ch}$ is the natural frequency of the oscillation, and $$\mu\in\mathbb{R}$$

denotes the bifurcation parameter. In the absence of external forcing, Equation 4 describes the generic differential equation displaying a Hopf bifurcation: For $\mu<0$ the solution $z(t)=0$ is a stable fixed point, whereas for $\mu>0$, the fixed-point solution becomes unstable and a stable limit-cycle of the form $z(t)=\sqrt{\mu}\exp(j\omega_{ch}t)$ appears. A nonzero forcing F yields (with the above Ansatz for z(t) for $\mu<0$):

$$\omega_{ch}Fe^{-j\theta}=(\mu+j)\omega_{ch}R-\gamma\omega_{ch}R^3-j\omega R.$$

Squaring and introducing the normalized frequency $\phi$ by $$\phi=\omega/\omega_{ch}$$

results in $$F^2=\gamma^2R^6-2\gamma\mu R^4+[\mu^2+(1-\phi)^2]R^2, \quad \text{(Equation 5)}$$

which is easily solvable. For $\mu=0$ and close to resonance $\omega=\omega_{ch}$, the response $R=F^{1/3}$ emerges, which forces the gain $G=R/F=F=F^{-2/3}$ to increase towards infinity as F approaches zero. This implies a compressive nonlinearity, for any stimulus size. For $\mu<0$ maintaining $\omega=\omega_{ch}$, we obtain the response $R=-F/\mu$ for weak stimuli F. As F increases, the term $R^6$ in Equation 5 can no longer be neglected, and, as $$\gamma R^6\approx\mu^2R^2+2\gamma\mu R^4,$$

the compressive nonlinear regime is entered. The transition point occurs at $$F_C\approx 0.91(-\mu)^{3/2}/\gamma^{1/2}.$$

For weak stimuli F, the response R is nearly linear, while for moderate stimuli the differential gain of the system, dR/dF, decreases with increasing stimulus intensity. Away from the resonance, the last term in Equation 5 dominates. In this case, the response is linear for every input, as $$R\approx F/|(1-\phi)|.$$

For $\mu>0$, stable limit-cycles emerge.

In the cochlea biology, the tensile forces that act on the stereocilia tip links can be considered as the input F(t) to the Hopf system, Equation 4. Using Hooke's law F~A, these forces can be related to the BM amplitude A. Because $A(x,\omega)\sim(e(x,\omega))^{1/2}$, it follows that $F(x,\omega)=(\sigma e(x,\omega))^{1/2}$ where $\sigma$ is the proportionality constant. For an ensemble of Hopf oscillators active at location x, the force amplitude will be proportional to R, and the power a delivered at location x will have the form $$\alpha(e,x,\omega)=L(R(\sqrt{\sigma e(x,\omega)}))^2,$$

where L is a second proportionality constant. The equipartition principle leads to $$A(x,\omega)=\sqrt{\frac{2e(x,\omega)}{E(x)}}.$$

The last two relations establish the connection between the cochlea differential equation and physiological measurements. Results from this model for stationary inputs were obtained via direct simulations of the differential equation. For transient signals, however, these equations are beyond usability, due to their computational demand.

To remedy this situation, it is presently suggested to decompose the cochlea into individual stages of characteristic frequencies, each of which is endowed with models of the passive hydrodynamic behavior and of the active Hopf-type amplification. An electronically implemented steady-state approximation of the driven Hopf amplifier, in combination with a simple fluid transfer function, implemented as a frequency-specific filter, provide the skeleton for the proposed implementation. These components are connected towards an amplification/filtering stage, and then these are connected towards a cascade of such stages modeling the entire cochlea.

FIG. 1 shows a block diagram of a biomorphic electronic device for analyzing an audio signal (henceforth simply called an "electronic cochlea") according to a preferred embodiment of the present invention.

The electronic cochlea comprises a Hilbert transformer followed by a plurality of amplification/filtering stages S1, S2, S3, . . . , S(n−1), Sn. Each amplification/filtering stage comprises a non-linear amplification module 100*a*, 100*b*, . . . , 100*c* and two filter modules 200*a*, 200*a*', 200*b*, 200*b*', . . . , 200*c*, 200*c*'. The non-linear amplification module essentially consists of a Hopf amplifier having two input terminals to which the real and imaginary parts of a complex-valued input signal are fed, and having two output terminals, at which the real and imaginary parts of a complex-valued output signal are provided. Each output signal is fed to one of the two essentially identical filter modules, which preferably act as Butterworth-type lowpass filters of sixth order. The output signals from the filter modules are fed to post-processing modules 600*a*, 600*b*, . . . , 600*c*, which, e.g., may comprise "inner hair cell" modules, "neuron" modules etc., as will be explained further below.

In operation, a real-valued audio input signal is provided to the Hilbert trans-former 500. In general terms, the audio input signal is a time-dependent electronic signal containing frequencies in the audio frequency range, i.e., broadly speaking in the range between 10 Hz and 50 kHz, more often between 20 Hz and 20 kHz. Often, it will be a signal obtained by a suitable microphone and amplified to match the input characteristics (input voltage range, input impedance) of the Hilbert transformer 500.

The Hilbert transformer acts to transform the real-valued input signal at its input 501 into a pair of real-valued output signals 502, 503, which essentially correspond to the real and imaginary parts of a time-dependent complex-valued audio signal. Embodiments of suitable Hilbert transformers are well known in the art, and any Hilbert transformer accomplishing the described transformation for signals in the audio range to sufficient accuracy (say, to less than 2% phase error in the audio frequency range, preferably less than 1% phase error) will be suitable for the present purpose. In particular, a Hilbert transformer may be set up by cascading pairs of (active) allpass filters, where each pair consists of one allpass filter each for the real and imaginary channels, and where the filter characteristics are designed such that the phase response of the imaginary channel lags behind the real channel by 90 degrees. An example of a Hilbert transformer covering about 8 octaves of frequency to sufficient accuracy is, e.g., given in (S. L. Hahn, Hilbert Transforms in Signal Processing, Artech House, London 1996, pp. 169-183). This document is incorporated herein by reference in its entirety for teaching the setup of a Hilbert transformer. The Hilbert trans-former may also be implemented digitally instead.

The output signals of the Hilbert transformer are then fed to the input terminals of the first amplification/filtering stage S1. There, they are subjected to nonlinear amplification by the Hopf amplifier in the nonlinear amplification module 100*a*. The output signals of the Hopf amplifier are then subjected to frequency filtering by the filter modules 200*a* and 200*a*'. The resulting signals are provided at the output terminals of the first amplification/filtering stage. From there, they are fed both to the input terminals of the next amplification/filtering stage, which acts in the same way as the first stage apart from different amplification and filtering characteristics, and to the postprocessing module 600*a* for analysis.

Figure 2:
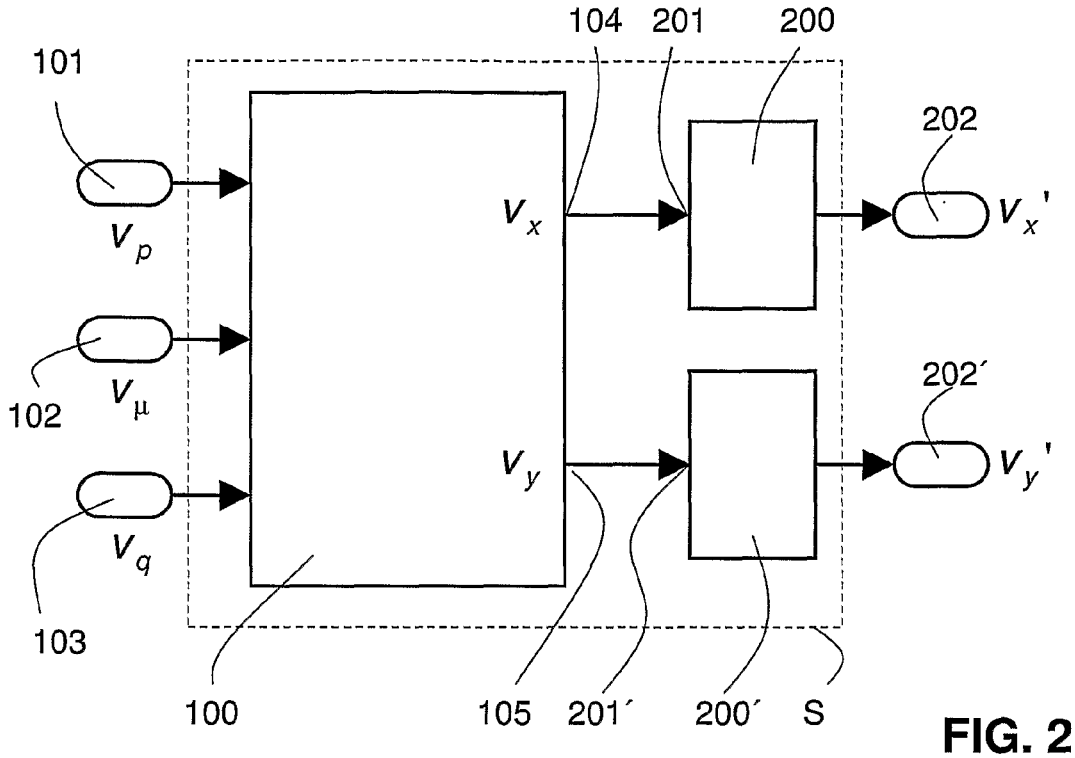
FIG. 2 shows a schematic block diagram of a single stage of an electronic cochlea according to FIG. 1.

A representative single stage S is shown in more detail in FIG. 2. The real part $v_p$ and the imaginary part $v_q$ of a complex-valued input signal $v_F=v_p+jv_q$ are fed to the input terminals 101, 103, respectively, of the nonlinear amplification module 100. At a third input terminal 102, a control voltage $v_\mu$ is provided. At its output terminals 104, 105, the nonlinear amplification module 100 provides the real part $v_x$ and the imaginary part $v_y$ of a complex-valued output signal $v_z=v_x+jv_y$, The real-part output signal $v_x$ is fed to the input terminal 201 of the first filter module 200, which provides an output signal $v_x'$ at its output terminal 202. Likewise, the imaginary-part signal $v_y$ is fed to the input terminal 201' of the second filter module 200', which provides an output signal $v_y'$ at its output terminal 202'. These signals may be considered as the real and imaginary parts of a complex-valued output signal $v_z'=v_x'+jv_y'$.

Figure 3:
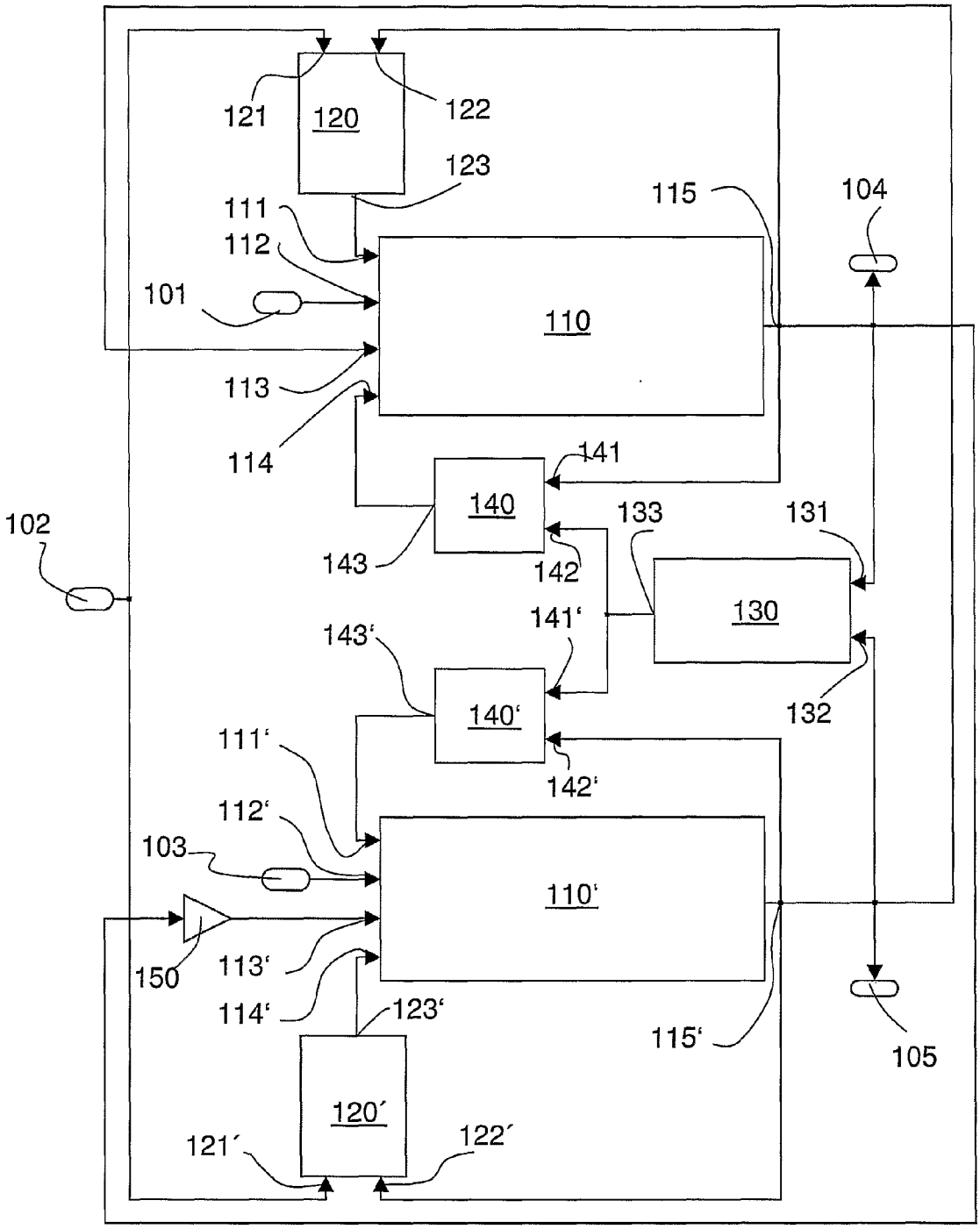
FIG. 3 shows a schematic block diagram of a Hopf oscillator.

FIG. 3 shows a schematic block diagram of the nonlinear amplification module 100. The signal provided at the input terminal 101 is fed to input 112 of a first integrative summer 110, which implements the functions of weighted addition of four input signals and integration of the resulting weighted sum. The output 115 of the integrative summer 110 is fed to the output terminal 104 of the nonlinear amplification module 100. Likewise, a second integrative summer 110' is pro-vided between the input terminal 103 and the output terminal 105 of the module 100. The integrative summers are connected to form an oscillator, i.e., the out-put 115' of the second integrative summer 110' is connected to input 113 of the first integrative summer 110, and the output of the first integrative summer 110 is connected via an inverter 150 to input 113' of the second integrative summer 110'.

In addition, the circuit comprises a nonlinear feedback network comprising units 130, 140 and 140', which implement nonlinear couplings. The inputs 131, 132 of an absolute-value forming unit 130 are connected to the outputs 115, 115' of the first and second integrative summer 110, 110', respectively. The unit acts to provide, at its output 133, a signal proportional to the sum of the squared input amplitudes, i.e., $|v_z|^2=v_x^2+v_y^2$. This output is then split and fed to two multipliers 140, 140'. The first multiplier 140 acts to multiply the output of the absolute-value forming unit 130 (at input terminal 142) with the output of the first integrative summer (at input terminal 141) and to provide the result (at output terminal 143) to input 114 of the integrative summer 110. In other words, a signal proportional to $v_x(v_x^2+v_y^2)$ is fed to input 114 of the integrative summer 110. Likewise, the second multiplier 140' provides a signal proportional to $v_y(v_x^2+v_y^2)$ to input 114' of the integrative summer 110'.

A further feedback path is implemented by multipliers 120, 120'. Control terminal 102 of the amplification/filter stage 100 is connected to the first input 121 of multiplier 120 and receives a control voltage $v_\mu$ corresponding to the control parameter μ of the Hopf amplifier. The second input 122 of the multiplier 120 is connected to the output 115 of integrative summer 110. The output 123 of multiplier 120, which is proportional to $v_\mu v_x$, is fed to input 111 of the integrative summer 110. Likewise, a signal proportional to $v_\mu v_y$ is fed to input 111' of integrative summer 110' by multiplier 120' having inputs 121', 122' and output 123'.

Figure 4:
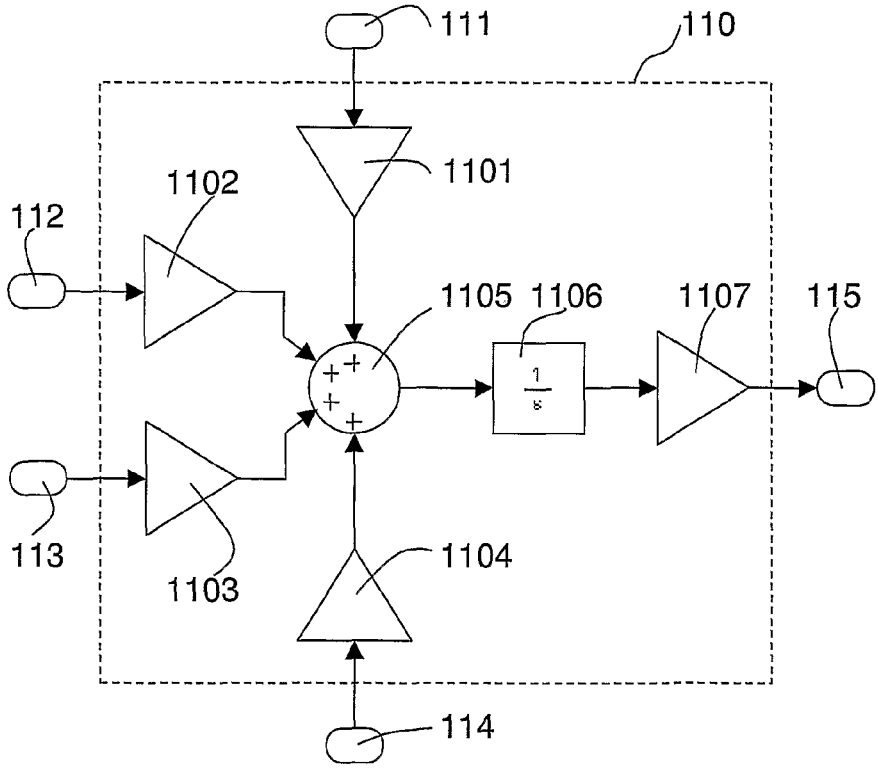
FIG. 4 shows a schematic block diagram of an integrative summer.

FIG. 4 shows a block diagram of the integrative summer 110. Each of the four input terminals 111, 112, 113, and 114 is connected to a gain adjuster (scaling unit) 1101, 1102, 1103, and 1104, respectively. The first gain adjuster provides a gain of $1/R_\mu$, providing appropriate scaling of the control voltage $v_\mu$. The second gain adjuster provides a gain of $1/R_F$, providing appropriate scaling of the input voltage (forcing term) $v_F$. The third gain adjuster provides a gain of $1/R_\omega$, providing an adjustment of the oscillator frequency. Finally, the fourth gain adjuster provides a gain of $1/R_\gamma$, providing scaling of the non-linear feed-back voltage which is fed to input 114 from the output 143 of multiplier 140. The outputs of all four gain adjusters are added in a summer 1105, whose output is provided to an integrator 1106, referenced by symbol $$\frac{1}{s}.$$

The output of integrator 1106 is scaled by −1/C in gain adjuster 1107, whose output is then provided to output terminal 115.

Taken together, the voltages in the nonlinear amplifier module 100 approximately satisfy the following equation:

$$\dot{v}_z=\left(\frac{-v_\mu}{mCR_\mu}+\frac{j}{CR_\omega}\right)v_z-\frac{|v_z|^2v_z}{2m^2CR_\gamma}-\frac{v_F}{CR_F}, \qquad \text{(Equation 6)}$$

where m is the inverse of the constant factor acquired in multipliers 120, 120', 140, 140', and in the absolute-value forming unit 130, respectively, according to the formula $$v_0=\frac{v_{i,1}\cdot v_{i,2}}{m}.$$

Here, $v_0$ is the output voltage of a selected unit, $v_{i,1}$, is the first input voltage, and $v_{i,2}$ is the second input voltage. It is assumed that the same constant scaling factor (attenuation) m is acquired in each of these units. Equation 6 is the Hopf differential equation.

In the following, some considerations on how the values $C, R_\mu, R_\omega, R_\gamma$, and $R_F$ may be suitably chosen shall be given.

To avoid op-amp saturation, the maximal input interval range that should remain uncompressed should be determined. This is the interval $$I=[0^+,F_C(\mu^*)]$$

where μ* is the lower boundary of a predetermined range of control parameters ($\mu\epsilon[\mu^*,0]$) and $F_C$ is the input amplitude above which compression (appreciable decrease of the amplifier gain) at the characteristic frequency occurs. The interval I then should correspond to the non-saturation regime, $v_{CC}$, of the op-amp. For determining the proper scaling, the voltages may be resealed according to $v_z=A_z z$, $v_F=A_F f$, $v_\mu=A_\mu\mu$, where $A_z$, $A_F$ and $A_\mu$ are scaling factors and z, f and μ are the rescaled voltages in the form as they appear in Equation 4. From Equation 6, the following equation is obtained:

$$\dot{z}=\left(\frac{-A_\mu\mu}{mCR_\mu}+\frac{j}{CR_\omega}\right)z-\frac{A_z^2|z|^2z}{2m^2CR_\gamma}-\frac{A_F f}{CR_F A_z}. \qquad \text{(Equation 7)}$$

The proper scaling thus suggests to set $A_F=v_{CC}/F_C$. To obtain a unitary gain, one may set $A_z=A_F$. The factor $A_\mu$, finally, could be set arbitrarily, but may be naturally chosen as $A_\mu=-v_{CC}/\mu$. At given capacitance C, the resistor values can then be calculated from the equivalence between Equations 4 and 7 as $$R_\omega = \frac{1}{C\omega_{ch}},\ R_\mu = \frac{-A_\mu}{mC\omega_{ch}},\ R_F = \frac{A_F}{A_z C\omega_{ch}},\ R_\gamma = \frac{A_z^2}{2m^2 C\gamma\omega_{ch}}, \quad \text{(Equation 8)}$$

with $\omega_{ch}>0$.

The parameter $\phi$ plays the same role as in linear filters: It relates the response curves to the characteristic frequency. Unlike linear filters, which are only de-pendent upon the normalized input frequency $\phi$, the Hopf amplifier response is also influenced by the input amplitude F. Furthermore, the response can be controlled by adjusting $\mu$. The linear gain, at the characteristic frequency, for small input signals is preserved by this scaling, as is the compressive gain with exponent −⅔ for increased input signal strength ($F>F_C$). For the interpretation of the circuit, it may be noted that the Hopf equation, Equation 4, with non-zero driving can be interpreted as a nonlinear filter, with a tunable gain control ("quality factor") $\mu$ and an envelope detector $|z|^2$. As the bandwidth $\Gamma$ follows the relationship $\Gamma\sim|\mu|$ (and $\Gamma\sim\gamma^{1/2}F^{2/3}$ for $F>F_C$), small $\mu$-values act as high Q-factors (sharp resonances). Upon increasing the size of $\mu$, the Q-factor decreases.

The following are examples for a possible choice of parameters and the resulting resistor and capacitance values. If, as an example, the values $\omega_{ch}=500$ rad $s^{-1}$, $\gamma_0=10^8$ and $\mu\in\{-10^3, -10^2, -10, -1\}$ are chosen, this leads to $F_C(\mu)\in\{3.1623, 0.1, 0.00316, 0.0001\}$, respectively. From the Hopf equation, Equation 4, it may be inferred that $\max|\mu|=10^3$, $\max|F|=1$, $\max|z|=0.00225$. With the choice $v_{CC}=10$ V, this leads to $A_\mu=-0.01$, $A_F=10$. Choosing $C=10^{-6}$ F yields $R_\omega=2$ kΩ, $R_\mu=10$ kΩ, $R^F=0.00225\Omega$, and $R_\gamma=987.63\Omega$, assuming (realistically) m=10.

Figure 5:
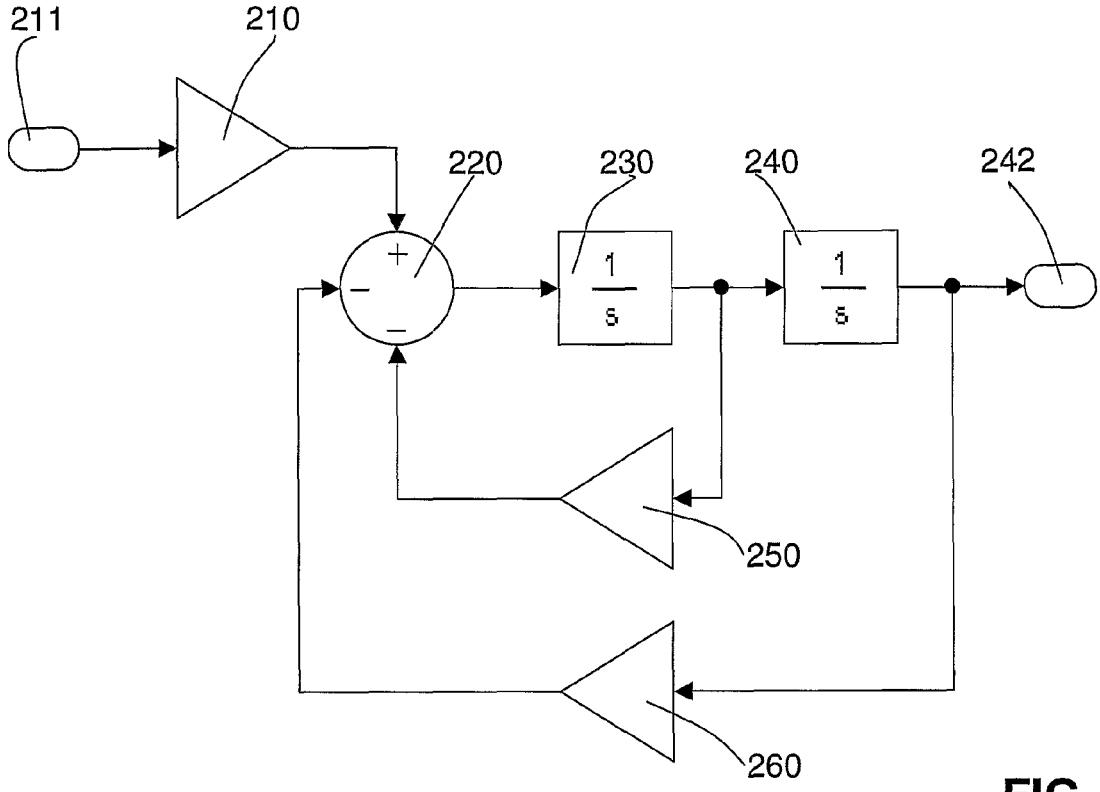
FIG. 5 shows a schematic block diagram of a filter stage.

In the following, the filter modules shall now be described. Each of the filter modules 200, 200' preferably implements, to a good degree of approximation, a sixth-order Butterworth lowpass filter. This is suggested by the general response generated by the Hopf cochlea differential equation, cf. Equation (3), obtained in numerical simulations. For reasons of simplicity, the sixth-order filter may be approximated by three second-order Butterworth lowpass filters connected in a series configuration. FIG. 5 shows a block diagram of an example of such a second-order Butterworth filter. Three of these filters are connected in series to form a filter module 200 or 200'. The filter has an input terminal 211 connected to a gain adjuster 210, which provides a gain of $1/(R_1R_3C_2C_4)$. The output of the gain adjuster is fed to a three-input summer 220. The output of this summer is fed to a first integrator 230, whose output is connected to the input of a second integrator 240. The output of the second integrator 240 is provided at an output terminal 242. The output of the first integrator 230 is scaled by a factor $(1/R_1+1/R_3)/C_2$ in a gain adjuster 250 and is fed back, with negative sign, to the second input of summer 220. The output of the second integrator 240 is scaled by a factor $1/(R_1R_3C_2C_4)$ in a gain adjuster 260 and is fed back, with negative sign, to the third input of summer 220.

In one example, the filter module was designed such that the following transfer function (overall filter module response) was obtained:

$$B_6(\hat{\phi}) = \frac{1}{(\hat{\phi}^2+\sqrt{2}\,\hat{\phi}+1)}\cdot\frac{1}{(\hat{\phi}^2+1.932\hat{\phi}+1)}\cdot\frac{1}{(\hat{\phi}^2+0.518\hat{\phi}+1)}. \quad \text{(Equation 9)}$$

Here, $\hat{\phi}=\omega/\omega_s$ denotes the reduced frequency for the filter module, where $\omega_s$ is the so-called stage frequency, which at the same time serves as the cutoff frequency of the filter module. Expressing Equation 9 in terms of such a reduced frequency allows to apply this equation universally for all stages of the electronic cochlea, the stages having different stage frequencies $\omega_s$. Evaluation of Equation 9 shows that at $\hat{\phi}=1$ (i.e., at $\omega=\omega_s$), the transfer function has fallen off to −30 dB of its value at $\hat{\phi}=0$. Generally, the cutoff frequency of the filter modules may be defined as being the frequency at which the filter response has fallen off to −30 dB of its maximum value.

The stage frequency $\omega_s$ may be chosen independently of the characteristic frequency $\omega_{ch}$ of the Hopf amplifier. The ratio between these two frequencies, called $\phi_s=\omega_s/\omega_{ch}$, may be different for each section. However, preferably a constant factor is chosen for all stages.

It will be readily apparent to the person skilled in the art how the resistor and capacitance values $R_1, R_3, C_2, C_4$ in each second-order Butterworth filter may be suitably chosen to obtain the response of Equation 9 or other desired responses for any given stage frequency $\omega_s$. In particular, if a filter has a transfer function of the form $$B_2(\hat{\phi}) = \frac{1}{(\hat{\phi}^2+a\hat{\phi}+b)},$$

these values may be calculated as follows:

$C_2$ and $C_4$ are chosen such that $$C_2 \geq C_4\cdot\frac{4b}{a^2}.$$

$R_3$ is chosen as $$R_3 = \frac{aC_2-\sqrt{a^2C_2^2-4bC_2C_4}}{2\omega_s C_2C_4}.$$

$R_1$ is chosen as $$R_1 = \frac{aC_2+\sqrt{a^2C_2^2-4bC_2C_4}}{2\omega_s C_2C_4}.$$

As an example, for $\omega_s=2\pi\cdot1480$ rad $s^{-1}$, the values in Table 1 were obtained for the capacitances and resistors in the three second-order Butterworth filters which together fulfil Equation 9.

TABLE 1

Capacitances and resistors for a particular filter module

| | $C_2$/nF | $C_4$/nF | $R_1$/kΩ | $R_3$/kΩ |
|---|---|---|---|---|
| 1st filter | 22 | 1 | 148.5 | 3.54 |
| 2nd filter | 22 | 1 | 205.2 | 2.56 |
| 3rd filter | 22 | 1 | 43.6 | 12.05 |

The following considerations may be made for the overall design of the cascade of amplification/filtering stages. To parametrically describe the design of each amplification/filtering stage, two parameters may be used. The first design parameter describes the detuning between the filter modules of a given stage and the Hopf amplifier of the same stage. It is given by the ratio of stage frequency $\omega_s$ of the filter modules of stage number i and the Hopf amplifier frequency $\omega_{ch}$ of the same stage: $\phi_s(i)=\omega_{s,i}/\omega_{ch,i}<1$, where i=1, . . . , n and n is the number of stages in the electronic cochlea. The second design parameter is the ratio between the characteristic frequencies of subsequent sections $$\Psi=\omega_{s,i+1}/\omega_{s,i}. \quad \text{(Equation 10)}$$

In terms of these two parameters, the design of a generic cascade element, the amplification/filtering stage, is now fully described.

The thus-described biomorphic electronic cochlea of FIGS. 1 to 5 may be readily implemented in either digital or analog electronics, or in a mixed implementation, in which only certain parts are implemented digitally, while others are implemented in analog electronics. If implemented in digital electronics, the implementation may be in hardware, e.g., on a suitably designed application-specific integrated circuit (ASIC), or in software on a general-purpose computer or for a suitable digital signal processor (DSP). For a digital implementation, an analog-to-digital converter (ADC) would be inserted before the input to the Hilbert transformer 500 to provide a digitized audio signal to the Hilbert trans-former. In a mixed implementation, e.g., the Hilbert transformer might be implemented in analog hardware, and its output signals might be digitized by two ADCs.

As an example, the above-described electronic cochlea of FIGS. 1 to 5 was implemented in software on a general-purpose computer, by using the MATLAB™ environment (version 7.0) with the Simulink™ package (version 6.2). These packages are available from The MathWorks, Inc., Natick, Mass. 01760, U.S.A. It may be noted that the block diagrams of FIGS. 1 to 5 may immediately be translated into a Simulink model. The Simulink model was used to successfully verify the hardware concept of the present invention. Further results obtained with this implementation will be discussed below.

Figure 6:
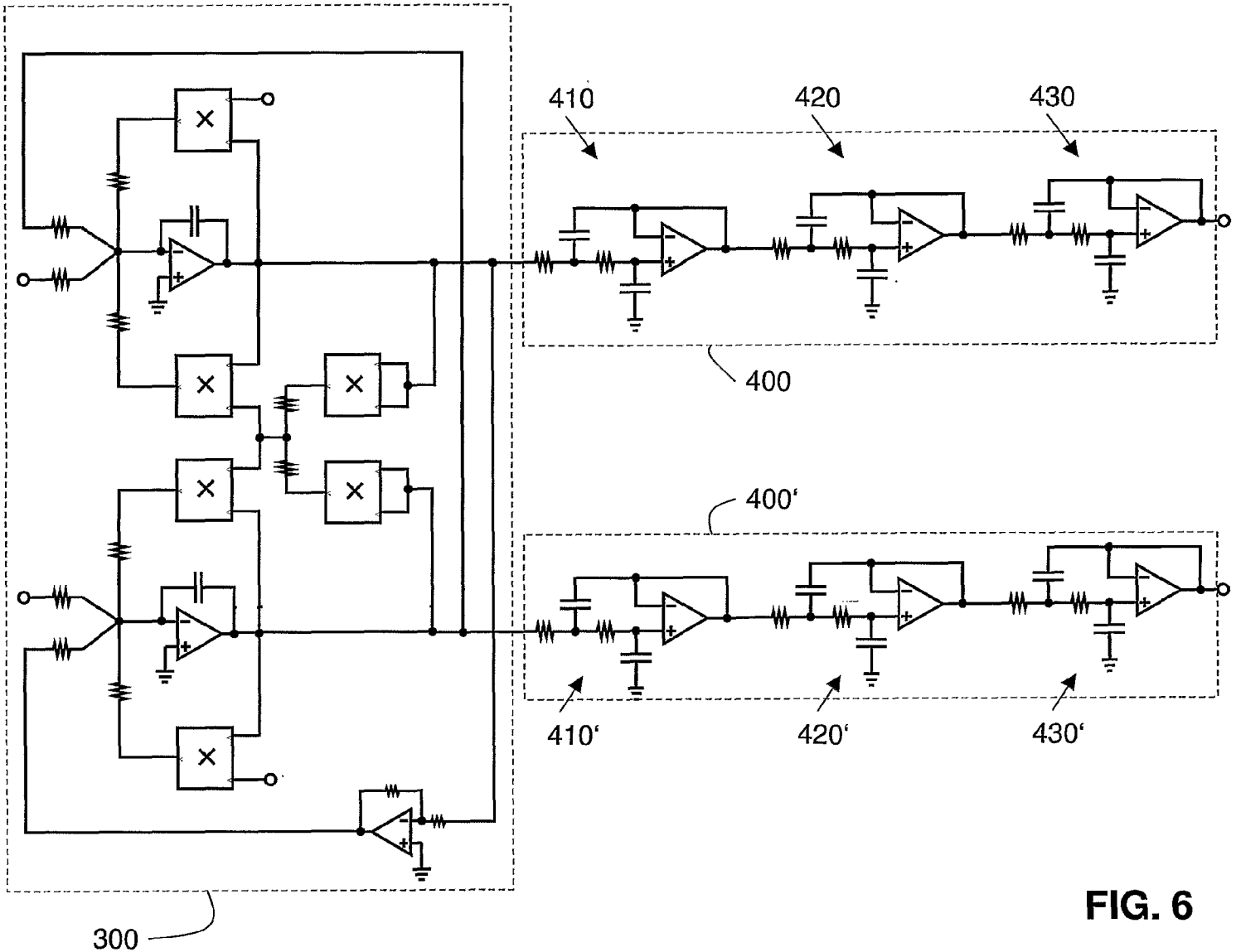
FIG. 6 shows an analog electronic implementation of a single stage of an electronic cochlea.
Figure 7:
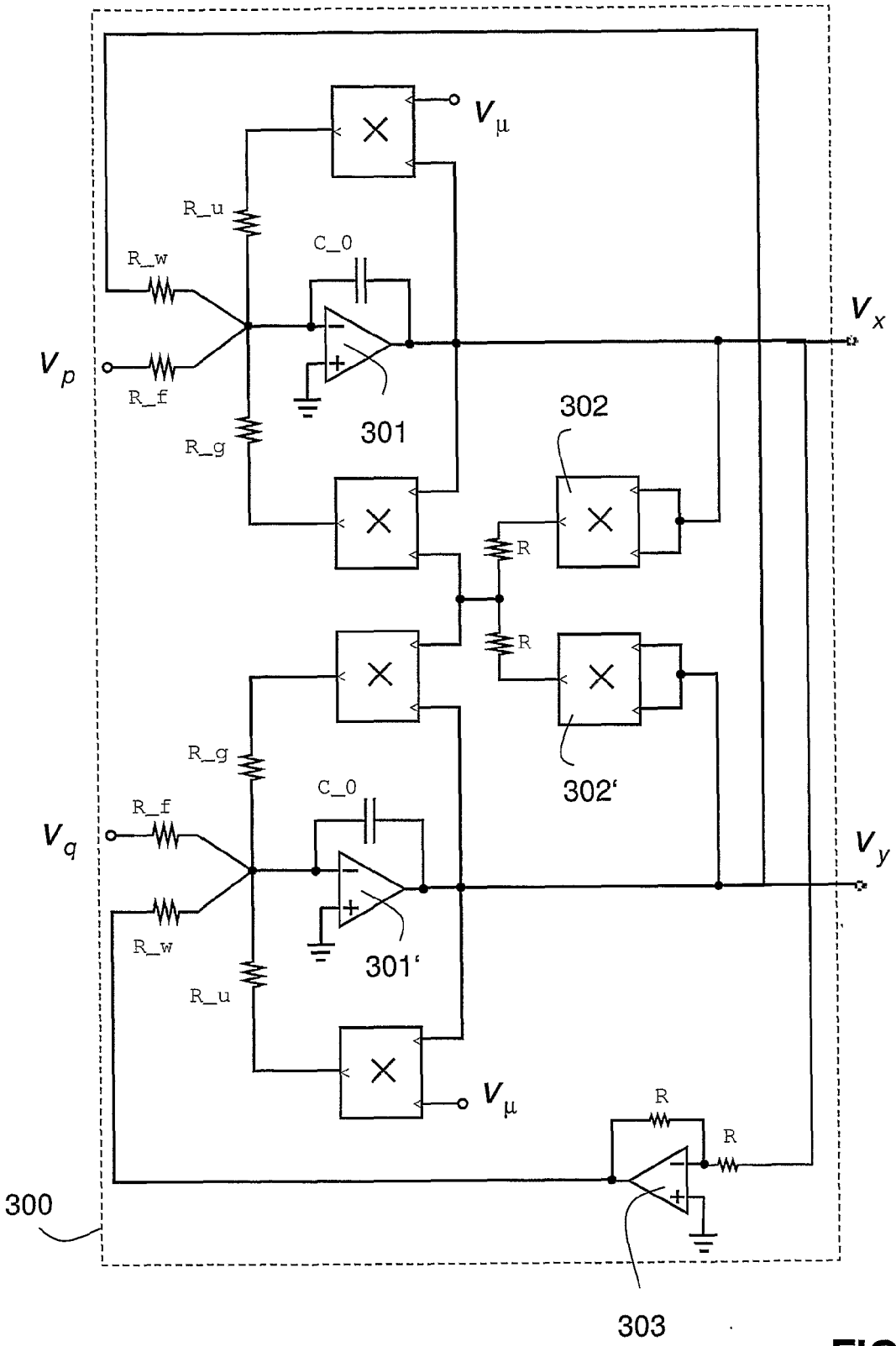
FIG. 7 shows an analog electronic implementation of a Hopf oscillator.
Figure 8:
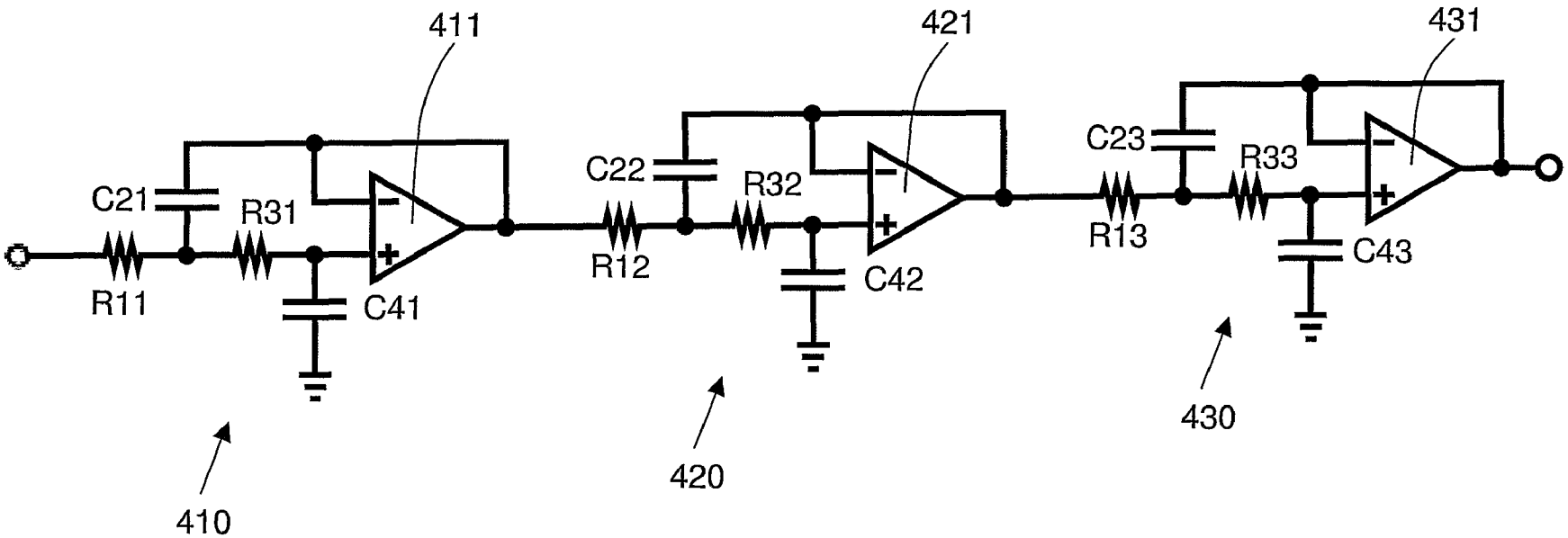
FIG. 8 shows an analog electronic implementation of a filter stage.

As another example, the electronic cochlea was implemented in analog hard-ware. FIGS. 6 to 8 show circuit diagrams of this analog electronic implementation.

FIG. 6 gives an overview over a single stage, implementing the generic stage S of FIG. 2. It essentially consists of a Hopf amplifier 300, followed by one filter circuit 400, 400' each for each of the two output channels of the Hopf amplifier.

FIG. 7 shows a detail view of the Hopf amplifier. The units of the block diagrams in FIGS. 3 and 4 correspond to the implementation as follows: Integrator 1106 and gain adjuster 1107 together are implemented by operational amplifier (op-amp) 301 and feedback capacitor C_0 (having value C). Gain adjusters 1101, 1102, 1103, and 1104 are implemented by resistors R_u (having value $R_\mu$), R_w (having value $R_\omega$), R_f (having value $R_F$), and R_g (having value $R_\gamma$), respectively. These units together implement the integrative summer 110. The absolute-value former 130 is implemented by two multipliers 302, 302' whose inputs are connected together to provide at their outputs the square of the respective input signal, and whose outputs are connected together via resistors R to form a common output. The inverter is implemented by an op-amp 303 and resistors R in the usual fashion. Op-amps of type TL082CP (available from Texas Instruments, Inc., Dallas, Tex. 75243, U.S.A.) were used for all op-amp functionalities, and multipliers of type AD734AN (available from Analog Devices, Inc., Norwood, Mass. 02062, U.S.A.) were used for all multiplier functionalities. In particular, the multipliers used had an internal attenuation of approximately m=10, as assumed in the above example for calculating resistor values. Of course, other types of op-amps and multipliers may be used, and the system may be readily miniaturized by designing a suitable integrated circuit combining the required functionalities.

FIG. 8 shows a detail view of a filter circuit 400. It essentially consists of three second-order Butterworth filter circuits connected in series. Each second-order Butterworth filter circuit comprises an op-amp whose output is fed back to the inverting input. The input to each filter circuit is fed to the non-inverting input of the respective op-amp via a series connection of resistors R11 and R31 in the first filter circuit (R12 and R32 in the second circuit, R13 and R33 in the third circuit). A capacitor C21 (C22, C23) is connected between the connection point between each pair of resistors and the inverting input of each op-amp. Another capacitor C41 (C42, C43) is connected between the non-inverting input of each op-amp and ground. It will be appreciated that this implementation is essentially equivalent to the block diagram of FIG. 5.

Both the digital implementation (MATLAB™/Simulink™) and the analog hard-ware implementation were subjected to extensive tests. For both implementations, the above-described basic design parameters were chosen as follows: the detuning parameter was set to $\phi_s=1.05^{-1}$ for all stages, and the frequency ratio between subsequent stages was set to $\Psi=0.84$. This leads to a span of one octave already for a small number of stages (four stages). $|\mu|$ was chosen between 0.01 and 1. Tests were performed with single cochlea stages as well as with electronic cochleae with up to seven stages connected in series.

Figure 9:
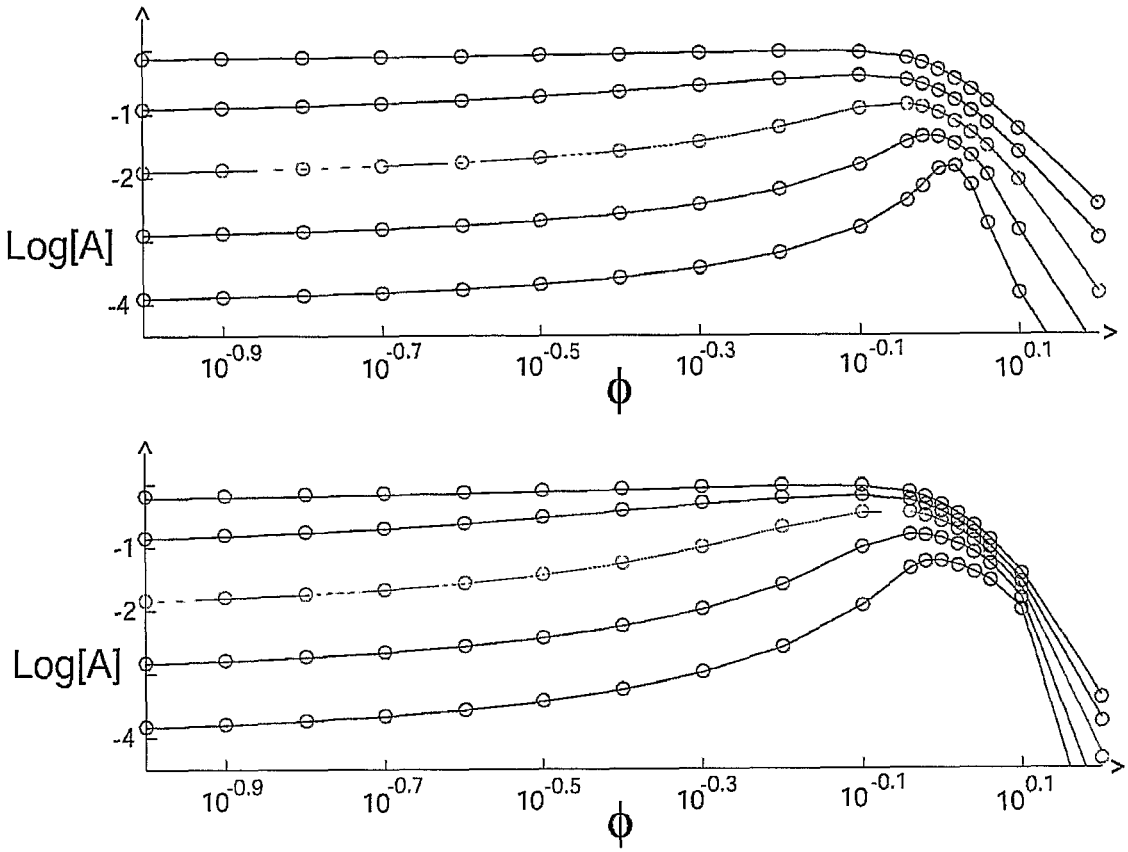
FIG. 9 shows output values from a one- and a two-section electronic cochlea.

FIG. 9 shows the output of a single cochlea stage (top diagram) and of the second stage of a two-stage electronic cochlea (bottom diagram). In both diagrams, the horizontal axis corresponds to the normalized frequency $\phi$, and the vertical axis corresponds to the base-10 logarithm of the amplitude (absolute value) A of the complex-valued output signal of the stage, $A=|v_z'|=\sqrt{v_x'^2+v_y'^2}$. Results are given for five different amplitudes of a stationary, sinusoidal input voltage $v_F$, these input amplitudes having a spacing of 10 dB. Circles denote measurements obtained from the analog hardware implementation, solid lines denote results from the Simulink implementation. The results from the Simulink implementation agree almost perfectly with the results from the analog hardware implementation. In addition, these results agree very well with numerical solutions of Equation 3 for stationary inputs. In particular, the results perfectly reproduce the key feature of the compressing nonlinearity in the vicinity of $\phi=1$ which is observed in both the solutions of Equation 3 and in physiological measurements.

Figure 10:
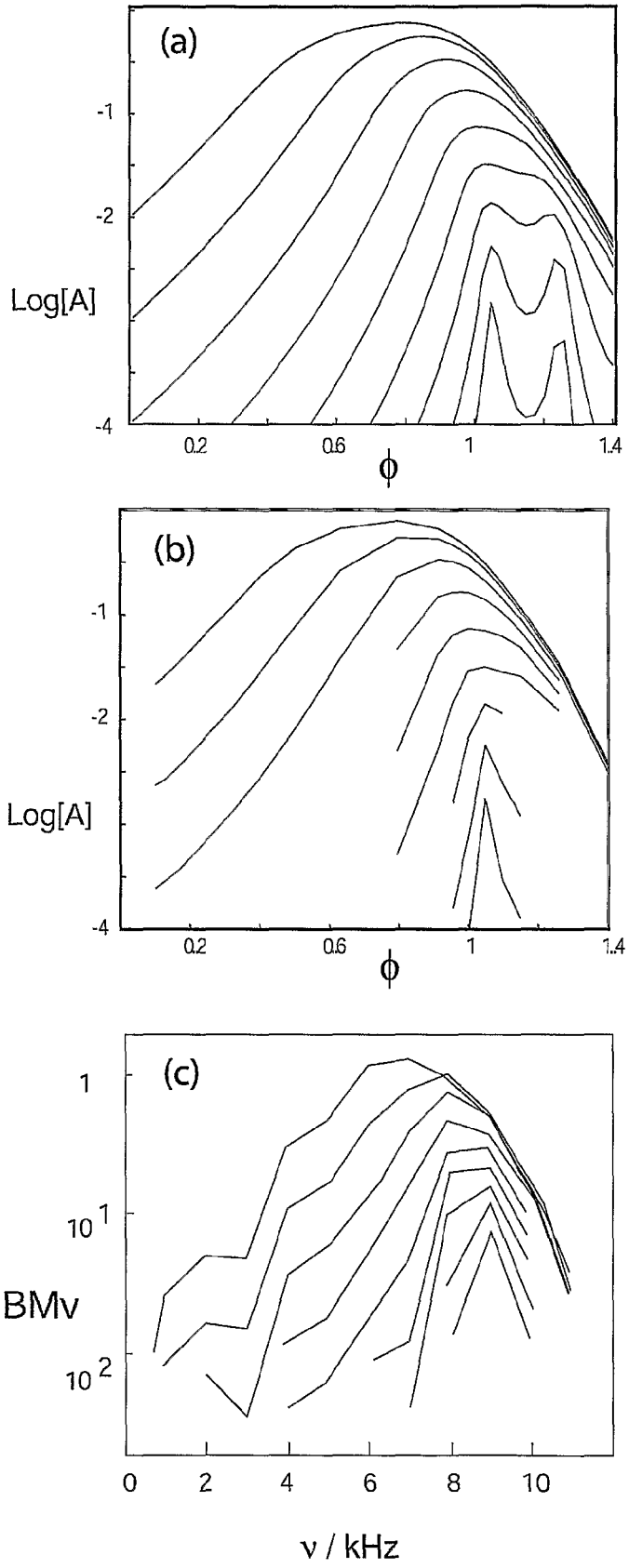
FIG. 10 shows output values of a simulated electronic cochlea, output values of an analog implementation, and the results of physiological measurements.

FIG. 10 shows a comparison of results from a Simulink implementation (top diagram) and an analog hardware implementation (middle diagram) of a five-stage electronic cochlea, together with physiological measurements on a mammalian cochlea (bottom diagram; data measured on a chinchilla cochlea, data taken from (M. A. Ruggero, "Responses to sound of the basilar membrane of the mammalian cochlea", Curr. Opin. Neurobiol. 2, 449-456 (1992))). Both the top and middle diagrams show the amplitude at the output of the respective fifth stage as a function of normalized frequency for nine different input amplitudes of constant input amplitude spacings of 10 dB. In the bottom diagram, the velocity of the basilar membrane, BMv, is shown as a function of the input frequency in kHz, at a fixed position on the BM. For the Simulink implementation, a double hump is observed in the response curves for low input amplitudes, which is a discretization effect resulting from the low number of stages involved. This hump disappears if a larger number of stages is employed (seven or more), or if the control parameter μ, which determines the bandwidth according to $\Gamma \sim |\mu|$ below $F_C$, is chosen more negative. The agreement with the measurements on the mammalian cochlea is excellent.

Thus, the analog hardware implementation of the electronic cochlea according to the present invention demonstrates an almost perfect agreement with the software implementation (Simulink) and biology, over more than four orders of magnitude of input amplitude and two orders of magnitude of the control parameter μ. Signal rise time and experiments with time-varying (transient) stimulations demonstrate results of similar quality.

Depending on the field of application of the device according to the present invention, the signals at the output terminals of the amplification/filtering stages may be subjected to appropriate post-processing steps in modules 600*a*, 600*b*, . . . , 600*c* of FIG. 1. A particularly simple kind of post-processing consists of forming the absolute value (or its square) for measurements of the kind presented in FIGS. 9 and 10. In this case, each post-processing module may comprise an absolute-value forming unit similar to the unit 130 of FIG. 3.

However, more sophisticated post-processing may be applied, in particular, post-processing steps which are again biomorphic. As an example, each post-processing module may comprise an "inner hair cell" (IHC) module and a "neuron" module. An IHC module will act to mimic the response of the inner hair cells of the biological cochlea to the vibrations of the basilar membrane. In particular, it will provide an output signal which decreases with time on the millisecond timescale from some initial output amplitude to some stationary output amplitude if subjected to a stationary sinusoidal input. Several different models for the IHC and implementations of such models in digital or analog hardware have been suggested in the literature, among these (A. McEwan and A. van Schaik, "An Analogue VLSI Implementation of the Meddis Inner Hair Cell Model", EURASIP Journal of Applied Signal Processing, Special Issue on Neuromorphic Signal Processing and Applications, 639-648 (2003)). This document is incorporated herein by reference in its entirety for teaching the implementation of an IHC model. The IHC module may be followed by a neuron module mimicking the response of a biological neuron to stimuli received from the IHC module. Several different neuron models and implementations have been suggested, among these (A. van Schaik, "Building blocks for electronic spiking neural networks", Neural Networks 14, 617 (2001), see, e.g., FIG. 1 of the document). This document is incorporated herein by reference in its entirety for teaching the implementation of a neuron model.

By providing suitable post-processing modules, the device of the present invention may be readily used as a hearing aid. For example, a hearing aid may comprise a device according to the present invention in which each post-processing module comprises at least a neuron module, preferably an IHC module followed by a neuron module. The outputs of the neuron modules may then be connected to electrodes in a cochlear implant which directly stimulate cochlear ganglion cells, inner hair cells, or auditory nerve cells in the vicinity of the inner hair cells. In this sense, the present invention also relates to a novel type of hearing aid.

Other types of post-processing may be applied in different types of applications, e.g., in robotics applications for an analysis of the auditory scene.

Figure 11:
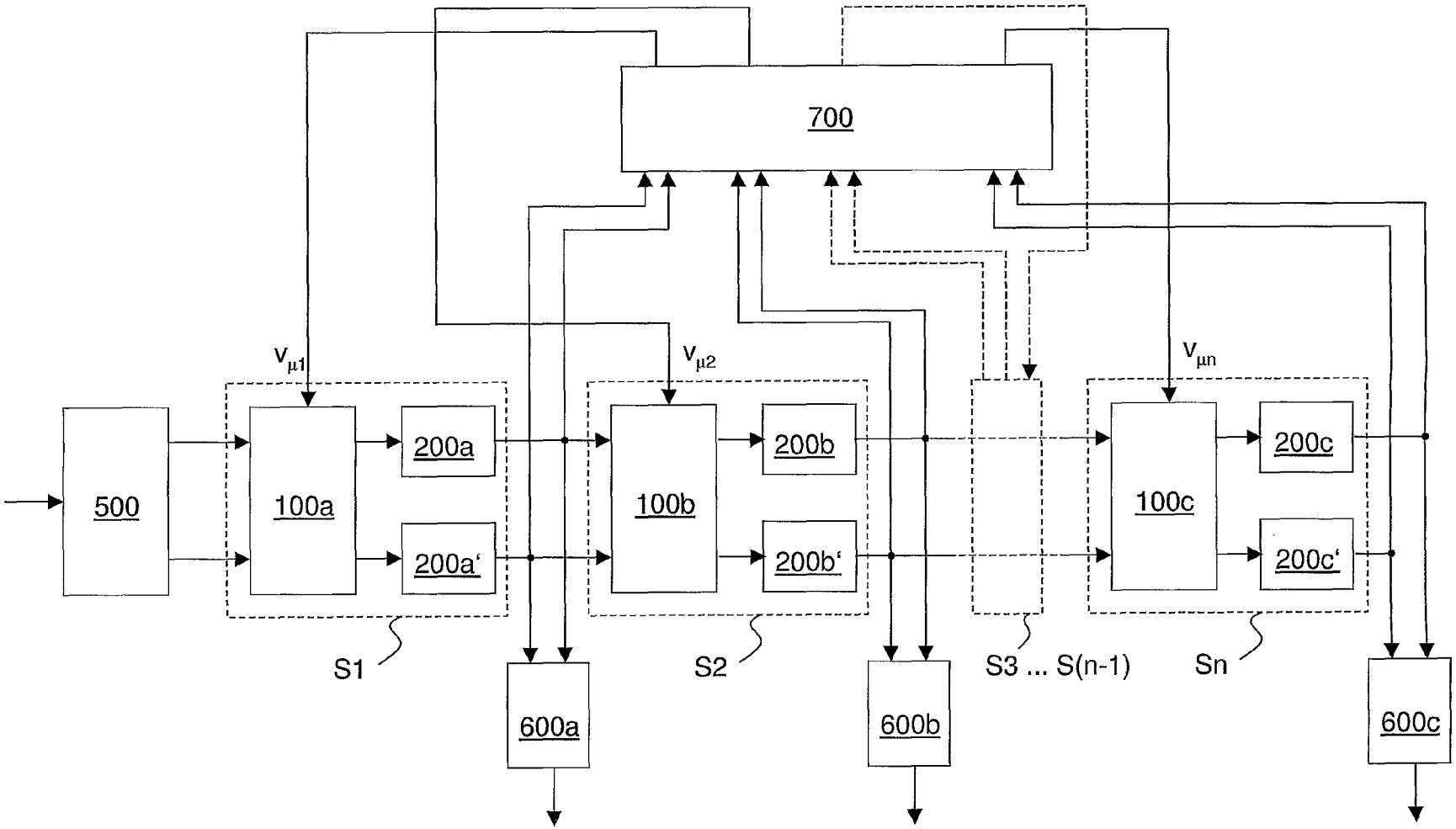
FIG. 11 shows a schematic block diagram of the electronic cochlea of FIG. 1 together with means for active feedback control.

In the implementations of the electronic cochlea according to FIGS. 1 to 8, the control voltage $v_\mu$ may be provided internally or externally. In the simplest case, the same control voltage is provided to all amplification/filtering stages, resulting in the same control parameter μ for all Hopf amplifiers. This may be readily achieved with an appropriate voltage source. In an advantageous embodiment, however, the device of the present invention comprises means for active control of the control parameter μ in all or in selected amplification/filtering stages, i.e., the output of all or of selected stages is used to derive improved control parameters which are used for active tuning to a certain desired sound source. This is illustrated in FIG. 11, which shows an electronic cochlea similar to the electronic cochlea of FIG. 1, however, further comprising an active control module 700. The active control module 700 receives the output signals of all or of selected stages of the electronic cochlea. At its outputs, it provides a plurality of control signals in the form of control voltages $v_{\mu 1}$, $v_{\mu 2}$, . . . $v_{\mu n}$, which are fed to all or to selected stages of the electronic cochlea for influencing the characteristics of the Hopf amplifiers. Many different embodiments of the active control are possible, only two of which shall be described as exemplary embodiments in the following.

According to one possible embodiment, the active control module 700 determines, for each cochlear section, the time dependence of the output amplitude. If the output amplitude of a particular stage exceeds a predetermined threshold for a predetermined period of time, the active control module will increase the absolute value of the control parameter μ for that particular stage, thereby increasing the bandwidth of that stage ("tuning away from the signal"). It will be readily apparent to a person skilled in the art how this may be implemented with the use of standard analog components, in particular using an integrator. This would mimic the amplitude response of the inner hair cells and feed back this response directly to the Hopf amplifiers.

In a more sophisticated embodiment, the output signals of all or of selected stages may be fed to a clustering algorithm, which acts to identify certain predefined features form the output pattern of the stages. Depending on the features identified, the algorithm adapts the values of the control parameters g in a fashion to actively tune the electronic cochlea to the selected feature, according to a predetermined rule. Such clustering algorithms are well known, e.g., in the field of library scanning in chemical analytics (see, e.g., T. Off et al., "Sequential Superparamagnetic Clustering for Unbiased Classification of High-Dimensional Chemical Data", J. Chem. Inf. Comput. Sci. 44, 1358-1364 (2004)) and may readily be adapted to the presently defined task. Before the signals are fed to the clustering algorithm, they may in addition be post-processed in a similar fashion as described above in connection with the post-processing modules 600*a*, . . . , 600*c*. Applications of such active tuning include both the improvement of hearing aids, where active tuning helps in overcoming the familiar "cocktail-party problem" (the inability of focusing to a certain source of sound when wearing a hearing aid), and robotics, where active tuning enables improved identification of certain sound patterns buried in background noise.

Figure 12:
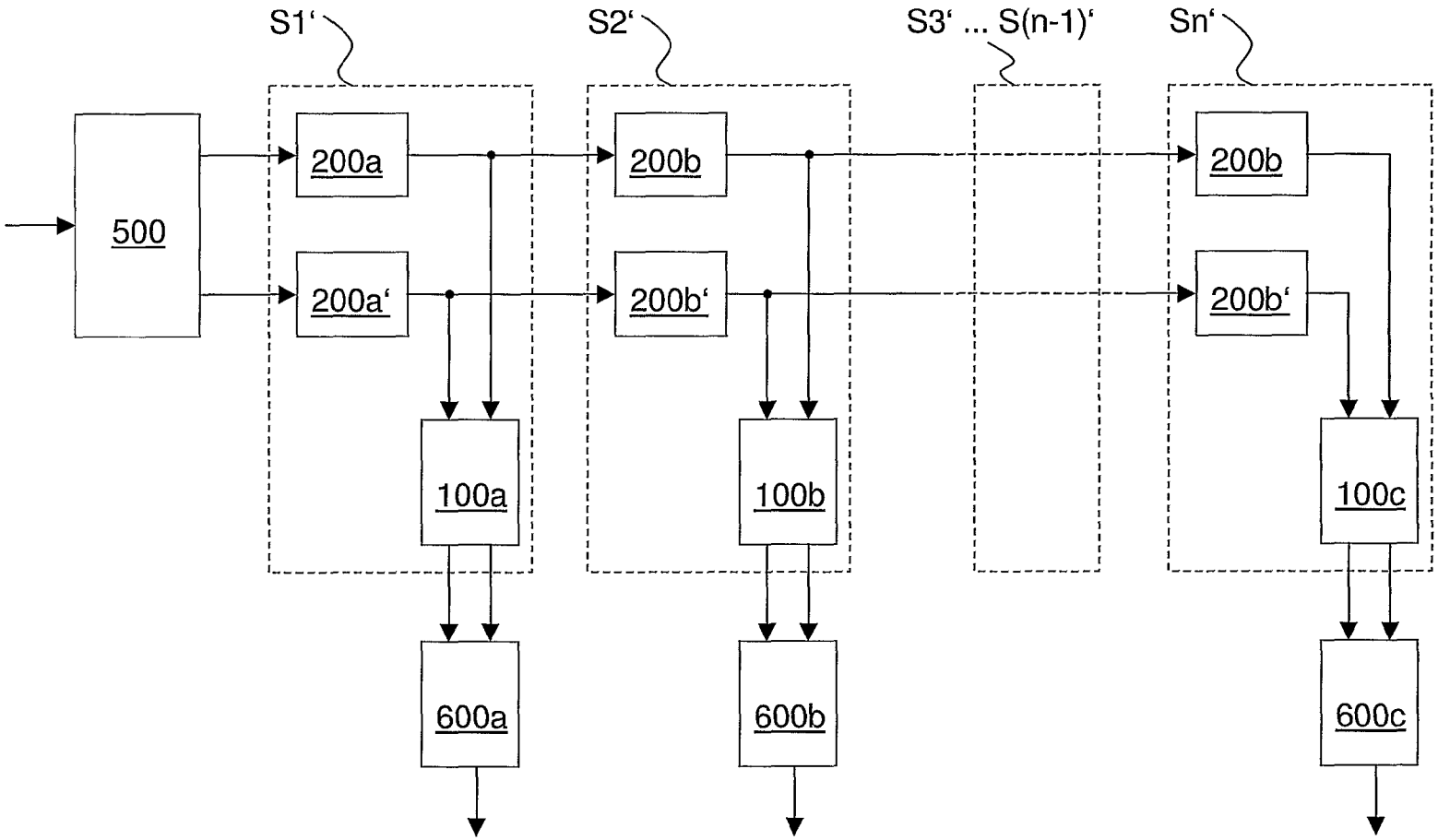
FIG. 12 shows a schematic block diagram of an alternative embodiment of an electronic cochlea.

Various changes to the above-described design are possible within the scope of the present invention. An example of a different embodiment of the electronic cochlea of the present invention is shown in FIG. 12. Again, the signal is split up into two channels, a real and an imaginary channel, by a Hilbert transformer 500. Each of the real and imaginary channels are fed through a series of stages S1', S2', S3', . . . , S(n−1)', Sn'. Each stage again comprises two filter modules and a nonlinear amplifier module. However, in contrast to the embodiment of FIG. 1, the output of each filter module is directly fed to the subsequent filter module, without first being passed through an amplifier module. Thus, each of the real and complex signals is passed through a sequence of filters connected in series in a feedforward fashion, and the output of each filter is independently fed to a nonlinear amplification module comprising a Hopf amplifier. Apart from the different setup, the modules used are preferably the same as in the above-described embodiments of FIGS. 1 to 8.

Another possible embodiment employs a series of nonlinear amplification modules comprising Hopf amplifiers connected in series in a feedforward fashion, and each output of each nonlinear amplification module is independently fed to a filter module. However, the embodiments of FIG. 1 or 12 are preferred.

Instead of using Hopf amplifiers, it is also possible to use nonlinear amplifiers with a different type of nonlinearity. It is, e.g., straightforward to devise a nonlinear amplifier implementing a nonlinearity of the form $|v_z|^4 v_z$, by feeding the output of absolute-value forming unit 130 in FIG. 3 to a squaring unit formed, e.g., by a multiplier with connected inputs.

In summary, the cochlear biophysics provides the design of a hearing sensor at minimal expense, where nonlinear signal processing characteristics (two-tone suppression, combination-tone generation) are naturally implemented. Efferent cochlear access points allow for a simple connection towards cognitive processes taking place in the cortex (humans) or in corresponding computing de-vices (e.g., for robots). Furnished with these benefits, the presently proposed biomorphic cochlea can be used to tackle the cocktail-party problem, in the robots context, as well as for re-establishing hearing with hearing-impaired hu-mans.

List of Reference Symbols

S, S1, S2, S3, . . . , S(n−1), Sn Cochlear amplification/filtering stage S1', S2', S3', . . . , S(n−1)', Sn' Cochlear amplification/filtering stage μ Control parameter $v_p$, $v_q$ Input voltage $v_x$, $v_y$ Amplifier output voltage $v_x'$, $v_y'$ Filter output voltage $v_\mu$, $v_{\mu 1}$, $v_{\mu 2}$ . . . $v_{\mu n}$ Control voltage R, R_u, R_w, R_f, R_g Resistors R11, R12, R13, R31, R32, R33 Resistors C_0, C21, C22, C23, C41, C42, C43 Capacitors ϕ Normalized frequency A Normalized output level ν Frequency BMv Velocity of basilar membrane

100, 100*a*, 100*b*, 100*c* Non-linear amplification module (Hopf amplifier)

101 Real-channel input terminal

102 Control terminal

103 Imaginary-channel input terminal

104 Real-channel output terminal

105 Imaginary-channel output terminal

110, 110' Integrative summer

111, 111' First input

112, 112' Second input

113, 113' Third input

114, 114' Fourth input

115, 115' Output

1101, 1102, 1103, 1104 Gain adjuster

1105 Summer

1106 Integrator

1107 Gain adjuster

120, 120', 140, 140' Multiplier

121, 121', 131, 141, 141' First input

122, 122', 132, 142, 142' Second input

123, 123', 133, 143, 143' Output

130 Absolute-value forming unit

150 Inverter

200, 200*a*, 200*b*, 200*c* Filter stage (real channel)

200', 200*a*', 200*b*', 200*c*'Filter stage (imaginary channel)

201 Real input channel

202 Real output channel

201' Imaginary input channel

202' Imaginary output channel

210 Gain adjuster

211 Input terminal

220 Summer

230, 240 Integrator

242 Output terminal

250, 260 Gain adjuster

300 Hopf amplifier (implementation)

301, 3011, 303 Operational amplifier

302, 302' Multiplier

400, 400' Butterworth filter

410, 410' Second-order Butterworth filter

420, 420' Second-order Butterworth filter

430, 430' Second-order Butterworth filter

411, 421, 431 Op-amp

500 Hilbert transformer module

501 Input terminal

502, 503 Output terminal

600*a*, 600*b*, 600*c* Post-processing module

601*a*, 601*b*, 601*c* Output terminal

700 Control module

The invention claimed is:

1. A device for analyzing sound, comprising a plurality of amplification/filtering stages (S1, S2, . . . , Sn), each amplification/filtering stage having at least one input terminal and at least one output terminal, said amplification/filtering stages being connected in a series configuration, each amplification/filtering stage comprising at least one nonlinear amplification module and at least one filter module providing high-frequency attenuation.

2. The device according to claim 1, wherein said at least one nonlinear amplification module comprises a Hopf-type amplifier.

3. The device according to claim 2, wherein said at least one nonlinear amplification module and said at least one filter module are connected in a series configuration between the at least one input terminal and the at least one output terminal of each amplification/filtering stage (S1, . . . , Sn).

4. The device according to claim 1, wherein said at least one nonlinear amplification module and said at least one filter module are connected in a series configuration between the at least one input terminal and the at least one output terminal of each amplification/filtering stage (S1, . . . , Sn).

5. The device according to claim 1, wherein said at least one nonlinear amplification module has a characteristic frequency, wherein said at least one filter module has a high-frequency cutoff frequency, and wherein said cutoff frequency is lower than said characteristic frequency.

6. A device for analyzing sound, comprising a plurality of amplification/filtering stages (S1, S2, . . . , Sn), each amplification/filtering stage having at least one input terminal and at least one output terminal, said amplification/filtering stages being connected in a series configuration, each amplification/filtering stage comprising at least one nonlinear amplification module and at least one filter module providing high-frequency attenuation, wherein each said amplification/filtering stage (S1, . . . , Sn) has a first input terminal for a first input signal ($v_p$), a second input terminal for a second input signal ($v_q$), a first output terminal for a first output signal ($v_x'$) and a second output terminal for a second output signal ($v_y'$), and wherein there is a signal path between said first input terminal and said first output terminal, between said first input terminal and said second output terminal, between said second input terminal and the second output terminal, and between the second input terminal and the first output terminal.

7. The device according to claim 6, wherein said device comprises a Hilbert transformer module having an input terminal for a real input signal and a first and a second output terminal, said Hilbert transformer module acting to transform said real input signal into a complex output signal, a real component of said complex output signal being fed to said first output terminal and an imaginary component of said complex output signal being fed to said second output terminal, wherein said first and second output terminals are connected to the first and second input terminals of the first of said amplification/filtering stages.

8. The device according to claim 7, wherein each amplification/filtering stage (S1, . . . , Sn) comprises a first filter module and a second filter module, said first filter module being connected directly or indirectly to the first input or the first output of said amplification/filtering stage (S1, . . . , Sn) and said second filter module being connected directly or indirectly to the second input or the second output of said amplification/filtering stage (S1, . . . , Sn), and wherein said first and second filter modules have essentially identical frequency characteristics.

9. The device according to claim 7, wherein said nonlinear amplification module comprises a first integrator having an input port connected directly or indirectly to said first input terminal of said nonlinear amplification module and having an output port connected directly or indirectly to said first output terminal of said nonlinear amplification module, a second integrator having an input port connected directly or indirectly to the second input terminal of said nonlinear amplification module and having an output port connected directly or indirectly to a second output terminal of said nonlinear amplification module, a positive feedback connection from the output port of said second integrator to the input port of said first integrator, a negative feedback connection from the output port of said first integrator to the input port of said second integrator, and nonlinear feedback means for providing a signal essentially proportional to $(v^2_x+v^2_y)^*v_x$ to the input port of said first integrator and for providing a signal essentially proportional to $(v^2_x+v^2_y)^*v_y$ to the input port of said second integrator, where $v_x$ is a voltage at the output port of said first integrator and $v_y$ is a voltage at the output port of said second integrator.

10. The device according to claim 6, wherein each amplification/filtering stage (S1, . . . , Sn) comprises a first filter module and a second filter module, said first filter module being connected directly or indirectly to the first input or the first output of said amplification/filtering stage (S1, . . . , Sn) and said second filter module being connected directly or indirectly to the second input or the second output of said amplification/filtering stage (S1, . . . , Sn), and wherein said first and second filter modules have essentially identical frequency characteristics.

11. The device according to claim 10, wherein said nonlinear amplification module comprises a first integrator having an input port connected directly or indirectly to said first input terminal of said nonlinear amplification module and having an output port connected directly or indirectly to said first output terminal of said nonlinear amplification module, a second integrator having an input port connected directly or indirectly to the second input terminal of said nonlinear amplification module and having an output port connected directly or indirectly to a second output terminal of said nonlinear amplification module, a positive feedback connection from the output port of said second integrator to the input port of said first integrator, a negative feedback connection from the output port of said first integrator to the input port of said second integrator, and nonlinear feedback means for providing a signal essentially proportional to $(v^2_x+v^2_y)^*v_x$ to the input port of said first integrator and for providing a signal essentially proportional to $(v^2_x+v^2_y)^*v_y$ to the input port of said second integrator, where $v_x$ is a voltage at the output port of said first integrator and $v_y$ is a voltage at the output port of said second integrator.

12. The device according to claim 6, wherein said nonlinear amplification module comprises a first integrator having an input port connected directly or indirectly to said first input terminal of said nonlinear amplification module and having an output port connected directly or indirectly to said first output terminal of said nonlinear amplification module, a second integrator having an input port connected directly or indirectly to the second input terminal of said nonlinear amplification module and having an output port connected directly or indirectly to a second output terminal of said nonlinear amplification module, a positive feedback connection from the output port of said second integrator to the input port of said first integrator, a negative feedback connection from the output port of said first integrator to the input port of said second integrator, and nonlinear feedback means for providing a signal essentially proportional to $(v^2_x+v^2_y)^*v_x$ to the input port of said first integrator and for providing a signal essentially proportional to $(v^2_x+v^2_y)^*v_y$ to the input port of said second integrator, where $v_x$ is a voltage at the output port of said first integrator and $v_y$ is a voltage at the output port of said second integrator.

13. The device according to claim 12, wherein said nonlinear amplification module further comprises a feedback connection between the output port and the input port of said first integrator, the amount of feedback being controllable by an external control parameter ($v_\mu$), and a feedback connection between the output port and the input port of said second integrator, the amount of feedback being controllable by said external control parameter ($v_\mu$).

14. A device for analyzing sound, comprising a plurality of amplification/filtering stages (S1, S2, . . . , Sn), each amplification/filtering stage having at least one input terminal and at least one output terminal, said amplification/filtering stages being connected in a series configuration, each amplification/filtering stage comprising at least one nonlinear amplification module and at least one filter module providing high-frequency attenuation, wherein said at least one filter module of each amplification/filtering stage (S1, . . . , Sn) comprises a lowpass or bandpass filter.

15. The device according to claim 14, wherein said lowpass or bandpass filter is of a Butterworth type, whose high-frequency falloff is of at least sixth order.

16. A device for analyzing sound, comprising a plurality of amplification/filtering stages (S1, S2, . . . , Sn), each amplification/filtering stage having at least one input terminal and at least one output terminal, said amplification/filtering stages being connected in a series configuration, each amplification/filtering stage comprising at least one nonlinear amplification module and at least one filter module providing high-frequency attenuation, further comprising a control module having at least one input terminal connected to at least one selected output terminal of at least one selected amplification/filtering stage (S1, . . . , Sn), and having at least one output terminal connected to a control terminal of at least one selected amplification/filtering stage (S1, . . . , Sn), said control module being operable to derive at least one control parameter ($v_{\mu 1}, \ldots, v_{\mu n}$) from signals provided to its input terminals and to provide said control parameter ($v_{\mu 1}, \ldots, v_{\mu n}$) to said control terminal.

17. A method of analyzing sound, wherein a plurality of complex-valued output signals are derived from a real-valued input signal, said method comprising:

deriving a complex-valued transformed input signal from said real-valued input signal; and subjecting said complex-valued transformed input signal to a sequence of amplification and filtering steps which are connected in a series configuration, wherein each amplification and filtering step results in one of said complex-valued output signals, and wherein each said complex-valued output signal serves as an input signal for the subsequent amplification and filtering step;

optionally, subjecting each complex-valued output signal to a post-processing step to obtain a modified output signal;

optionally, deriving a set of control parameters from said plurality of output signals and controlling said amplification and filtering steps by said set of control parameters, wherein each amplification and filtering step comprises a non-linear amplification step preferably exhibiting Hopf-type amplification and a filtering step with a predetermined high-frequency cutoff.

* * * * *